United States Patent [19]

Hogan

[11] 4,079,541

[45] * Mar. 21, 1978

[54] TRUNCATED ICOSAHEDRAL BLOCKS

[76] Inventor: John P. Hogan, 600 Elm St., Williamsburg, Iowa 52361

[ * ] Notice: The portion of the term of this patent subsequent to May 4, 1993, has been disclaimed.

[21] Appl. No.: 674,936

[22] Filed: Apr. 8, 1976

[51] Int. Cl.[2] ..... A63H 33/10

[52] U.S. Cl. ..... 46/26

[58] Field of Search ..... 46/24, 25, 26; 35/34, 35/72; 52/81, DIG. 10, 608; 206/436

[56] References Cited

U.S. PATENT DOCUMENTS

| | | | |
|---|---|---|---|
| 3,502,091 | 3/1970 | Corbin | 52/DIG. 10 |
| 3,604,130 | 9/1971 | Forrstrom | 35/34 |
| 3,660,952 | 5/1972 | Wilson | 52/81 |

FOREIGN PATENT DOCUMENTS

| | | | |
|---|---|---|---|
| 1,331,238 | 5/1963 | France | 52/81 |

OTHER PUBLICATIONS

Cundy & Rollett-Mathematical Models, 2nd ed. copyright 1961, pub. by Oxford Univ. Press, London, pp. 98-99.

*Primary Examiner*—F. Barry Shay

[57] ABSTRACT

The truncated icosahedral blocks are designed to meet one another along their truncation surfaces and thereby imitate an icosahedron's unique ability for three-dimensional intersection with another icosahedron, so that a line segment that defines the base of a pentangular pyramid on one icosahedron also defines the base of a pentangular pyramid on the other icosahedron.

5 Claims, 21 Drawing Figures

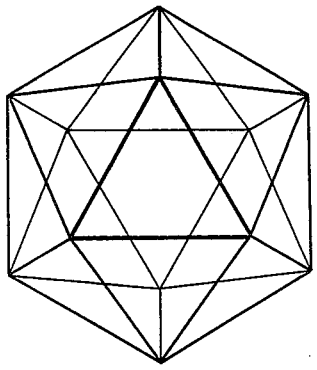
FIG. 1
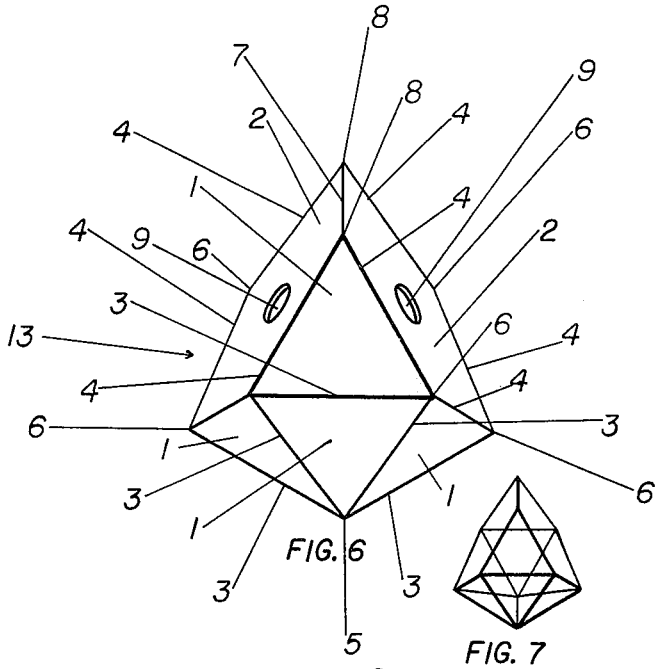
FIG. 6
FIG. 7
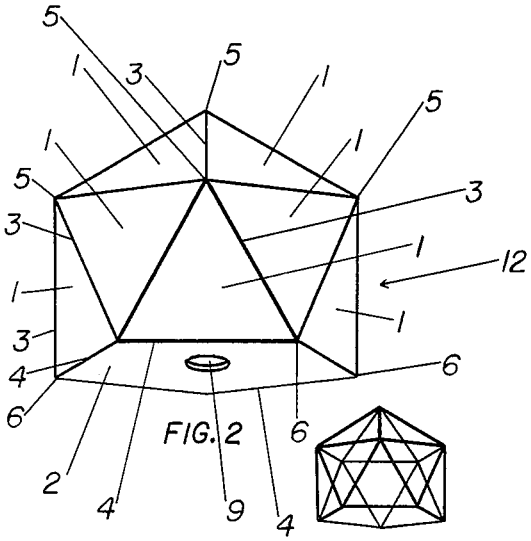
FIG. 2
FIG. 3
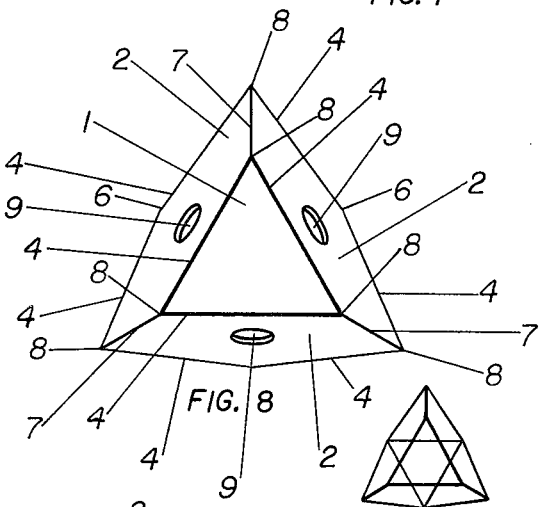
FIG. 8
FIG. 9
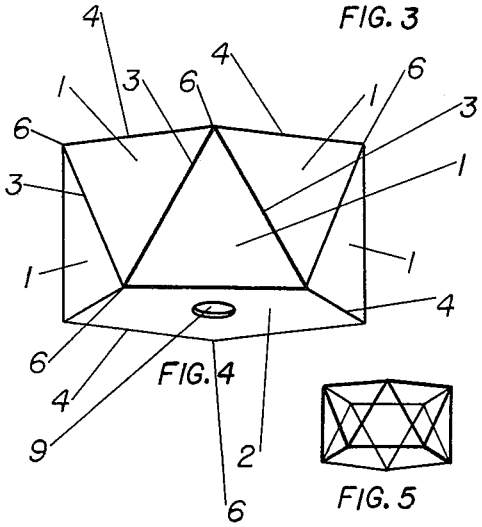
FIG. 4
FIG. 5
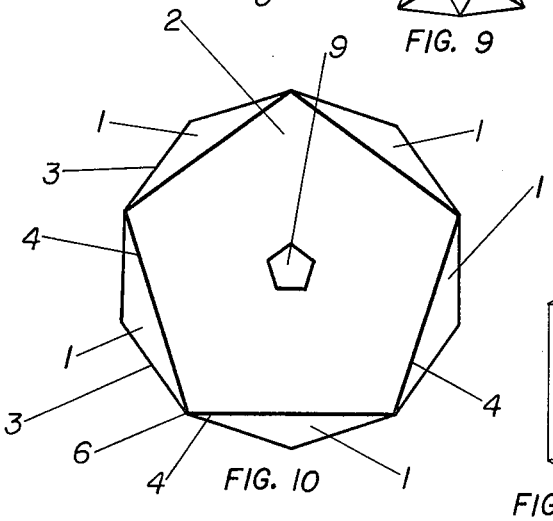
FIG. 10
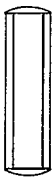
FIG. 11

TRUNCATED ICOSAHEDRAL BLOCKS

In an application entitled Homohedral Module (Ser. No. 518,529, filed 10/29/74; now U.S. Pat. No. 3,950,888), I disclosed a toy block that, when joined to an identical block, could imitate an icosahedron's unique ability for three-dimensional intersection with another icosahedron so that a line segment that defines the base of a pentangular pyramid on one icosahedron also defines the base of a pentangular pyramid on the other icosahedron. This imitation by the module of fused icosahedra is total in configurations with a topological genus of zero or one. Any configurations that have a topological genus of two or more are impossible to recreate by using the module alone. The present invention is a set of blocks which can be used in various combinations to duplicate the geometric configurations realized by the module, as well as all configurations that have a topological genus of two or more.

Up to four different blocks could be included in any one set. One block would be formed from an icosahedron which has had one pentangular pyramid removed by truncation from its surface. Two blocks would be formed from icosahedra that have had two pentangular pyramids removed by truncation from their surfaces. On one such double truncated block, the surfaces created by the truncations are tangent along one edge. The remaining double truncated block would have truncation created surfaces that will not be tangent. The fourth block would be formed from an icosahedron that has had three separate pentangular pyramids removed by truncation from its surface.

The purpose of the present invention is to offer a child or curious adult an alternate means to explore the geometric patterns and forms that are natural to intersecting icosahedra. Additional purposes and advantages will manifest themselves in the following description of specific embodiments of this invention, made in combination with the accompanying drawings in which:

FIG. 1 is a regular icosahedron.

FIG. 2 is a front view of a single truncated icosahedral block.

FIG. 3 is a single truncated regular icosahedron.

FIG. 4 is a front view of a double truncated icosahedral block with non-tangent truncation surfaces.

FIG. 5 is a double truncated regular icosahedron with parallel planes of truncation.

FIG. 6 is a front view of a double truncated icosahedral block with truncation surfaces that are tangent along one edge.

FIG. 7 is a double truncated regular icosahedron with planes of truncation that are tangent along one edge.

FIG. 8 is a front view of a triple truncated icosahedral block.

FIG. 9 is a triple truncated regular icosahedron.

FIG. 10 is a front view of a block's truncation surface.

FIG. 11 is a front view of a connecting pin.

Figure 12:
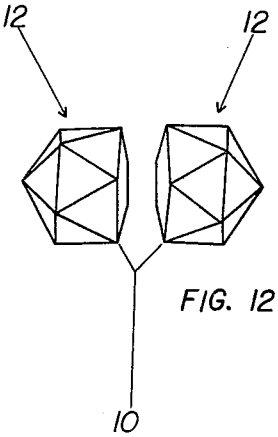
FIG. 12 is a perspective view of a pair of blocks that form a six-edged convex-concave vertex.

The icosahedron has a means of space filling interaction with other icosahedra that is unique. It occurs when a pentangular line segment that defines the base of a pentangular pyramid on the surface of one icosahedron also defines the base of a pentangular pyramid of an intersecting icosahedron. Such a fusion of two icosahedra generates a new geometric solid composed of thirty triangular faces which has five edges on its surface with concave dihedral angles. When a plurality of icosahedra fuse, endless varieties of solid geometric patterns can be formed, usually dominated by circular and helical groupings. On any one icosahedron, there are up to four different arrangements of up to three separate pentangular pyramids which will serve as areas of intersection. These separate pentangular pyramids may also be removed, leaving an icosahedron with up to three truncations on its surface. Such icosahedra can be arranged so that their truncated surfaces abut one another. When this is done, the truncated icosahedra will simulate intersecting icosahedra.

The simplest truncated icosahedral block is, in its preferred embodiment FIG. 2, patterned after a regular icosahedron FIG. 1, from which one pentangular pyramid has been removed by a planar truncation FIG. 3. Its surface is composed of fifteen identical equilateral triangles 1 and one regular pentagon 2 whose sides are identical in length to the sides on any of the triangles. There are twenty edges 3 (icosahedral) that form the limits of the triangles. They have simple convex dihedral angles that are identical to each other and to those generated on the surface of a regular icosahedron FIG. 1. The remaining five block edges 4 are coplanar and have double convex dihedral angles — angles that are identical to each other and to those generated between a triangle and a pentagon on the surface of a regular icosahedron from which a pentangular pyramid has been removed by a planar truncation. There are six icosahedral vertices 5, from which the twenty convex edges radiate, and five simple truncated vertices 6 that occur along the plane of truncation.

The two forms of double truncated icosahedral blocks are based, in their preferred embodiments, on two different double truncated regular icosahedra FIGS. 5 and 7. On one, the A type block FIG. 6, the planes of truncation are tangent along one edge 7. The other block, the type B FIG. 4, has truncation planes that are parallel. The type B block has twelve surfaces, ten that are equilateral triangular 1 and two that are regular pentangular 2. There are ten simple truncated vertices 6, five of which occur along each plane of truncation. Each group of five vertices are interconnected along their respective pentangular planes by five double convex edges 4 (a total of ten double convex edges). Ten more edges, icosahedral edges 3, interconnect the two groups of five vertices on the block's surface. The type A block FIG. 6 also has twelve surfaces, ten of which are equilateral triangular 1 and two that are regular pentangular 2. But there are only six simple truncated vertices 6. The remaining four vertices are evenly divided: two are icosahedral 5 and two are double truncated 8. A double truncated vertex is generated by a cluster of two pentagons and a triangle; on the type A block they define the limits of the edge 7 that occurs between two tangent pentagons. Eleven edges are icosahedral 3: nine radiate from the two icosahedral vertices 5, while two interconnect the two sets of simple truncated vertices 6 that occur on either side of the double truncated vertices 8. Eight edges are double convex 4 and interconnect the simple truncated vertices 6 and the simple truncated to the double truncated vertices 8 on each plane. The remaining edge is a triple convex edge 7; it acts as the border between the two tangent pentangular planes 2.

The triple truncated icosahedral block FIG. 8 is modeled, in its preferred embodiment, after a triple truncated regular icosahedron FIG. 9. Like the type A truncated icosahedral block FIG. 6, its planes of truncation are tangent. It has eight surface planes: five of them are equilateral triangular 1, while three are regular pentangular 2. There are no icosahedral vertices on the block, but there are three simple truncated 6 and six double truncated vertices 8. Three of the edges are icosahedral 3 (simple convex) and interconnect the three simple truncated vertices 6. There are nine double convex edges 4, six join the simple truncated vertices 6 to the double truncated vertices 8, while the remaining three "double" edges 4 connect three double truncated vertices 8 along their non-tangent edges. Three triple convex edges 7 connect the six double truncated vertices 8 and serve as the borders among the tangent pentangular planes.

On any truncated icosahedral block there is a means of attachment to other truncated icosahedral blocks. This means of attachment, in its preferred embodiment, is located at the center of the plane of truncation 9. It is an aperture, in which a pin FIG. 11 may be secured and used to secure another truncated icosahedral block. Although this aperture could easily be made circular 9, FIG. 2, I prefer that it be made pentangular 9 FIG. 10 and obviously a pentangular pin FIG. 11 be used with it. By doing so, the joined blocks will not have a tendency to pivot about their joining pins and ruin their geometrical configurations.

In their preferred embodiment, the blocks will be made out of a plastic and either blow or rotational molded. But variations are not ruled out. Parts could be injection molded, and then assembled to form the specific block. In fact a great variety of materials, including wood, metal, paper, cardboard as well as plastics, could be used by themselves to produce solid blocks; or they could be used piece by piece, in any combination, to fabricate the blocks from an assemblage of component parts.

Other variations are possible, perhaps even unavoidable. For safety, the means of attachment could be other than a relatively small pin. Adhesives might be used, or simply a raised design on any truncated surface might be designed to interlock with another design on another truncated surface.

Figure 18:
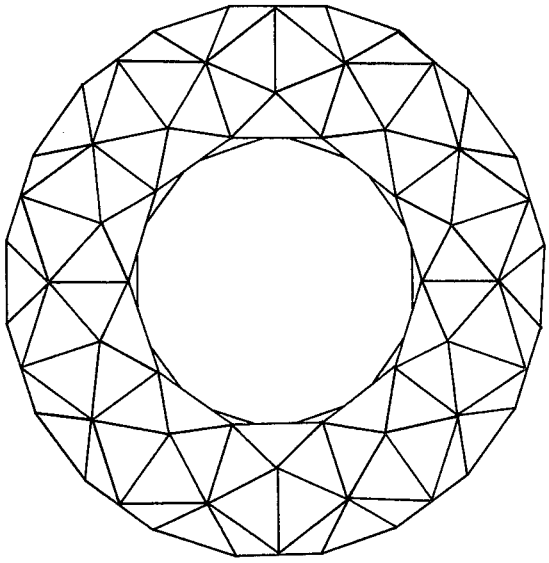
FIG. 18 is a top perspective view of a homohedral ring.
Figure 19:
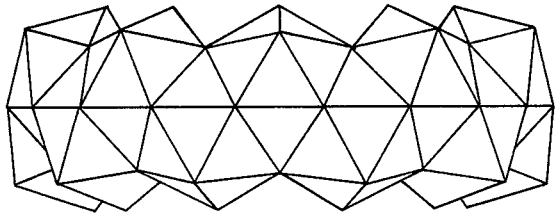
FIG. 19 is a side view of a homohedral ring.
Figure 20:
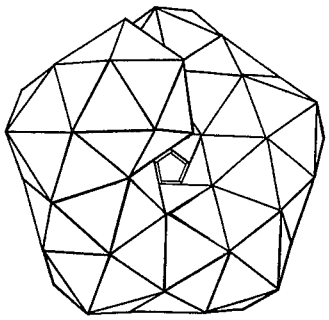
FIG. 20 is a top perspective view of a heavenly helix.
Figure 21:
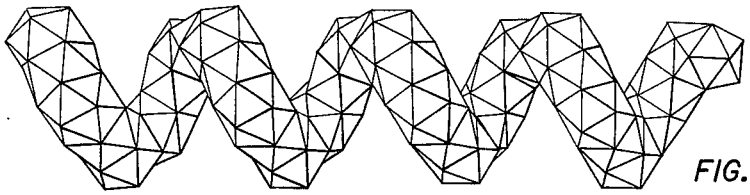
FIG. 21 is a side perspective view of a heavenly helix.

The greatest variation will be in the shape of the blocks themselves. Instead of being modeled after truncated regular icosahedra FIGS. 3, 5, 7 and 9, the blocks could be designed to imitate irregular icosahedra. This may be necessary so that the blocks will be able to form some of the circular configurations FIGS. 18–19. Helical configurations FIGS. 20–21 can be generated from either regular or irregular icosahedral blocks since, in forming a helical design, the joined blocks do not close in upon themselves to form geometric solids with a topological genus of one.

Figure 13:
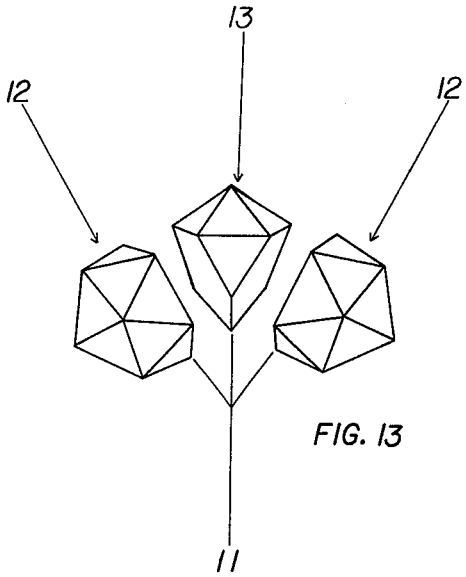
FIG. 13 is a perspective view of a set of blocks that form a seven-edged convex-concave vertex.
Figure 14:
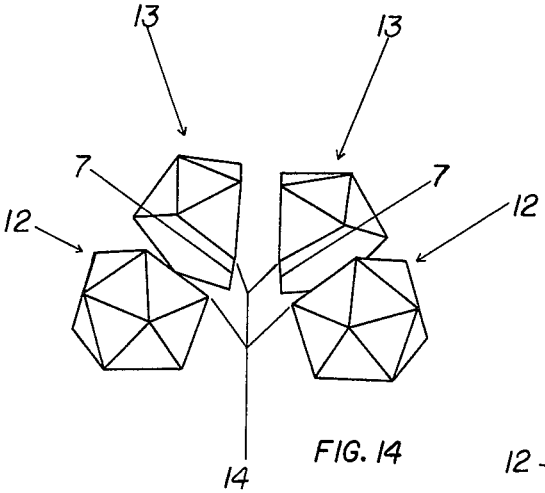
FIG. 14 is a perspective view of a set of blocks that form an eight-edged convex-concave vertex.
Figure 15:
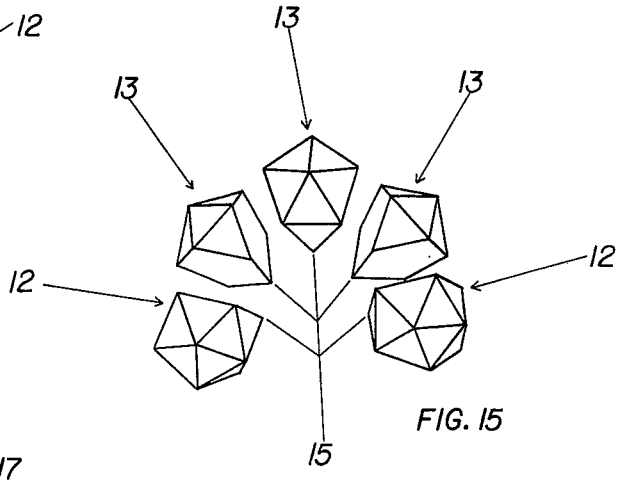
FIG. 15 is a perspective view of a set of blocks that form a nine-edged convex-concave vertex.
Figure 16:
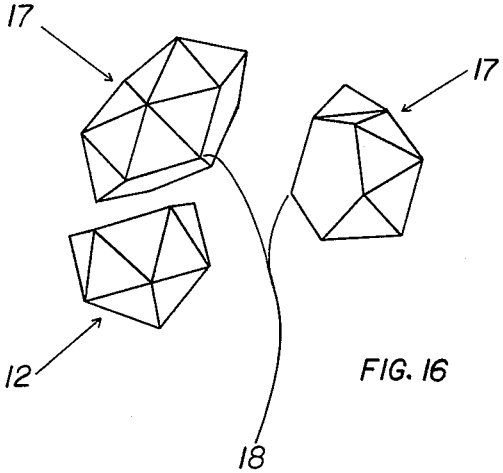
FIG. 16 is a perspective view of a set of blocks that form a section of a ten-edged convex-concave vertex.
Figure 17:
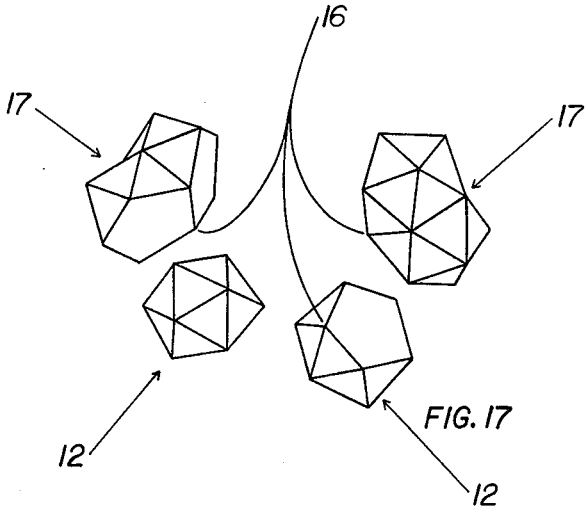
FIG. 17 is a perspective view of a set of blocks that form a ten-edged convex-concave vertex.

In spite of the variations in shape, composition and means of attachment, the blocks cluster together to form only five different convex-concave vertices among themselves. The simplest, the six-edged convex-concave vertex 10, is formed on the concave edge present when two single truncated blocks are made to abut FIG. 12. A seven-edged convex-concave vertex 11 appears when two single truncated blocks 12 abut a type A double truncated block 13 FIG. 13. An eight-edged convex-concave vertex 14 occurs when two type A double truncated blocks 13 abut so that their triple convex edges 7 are tangent, and their remaining exposed truncation surfaces are joined to single truncated blocks 12 FIG. 14. A nine-edged convex-concave vertex 15 can be derived from the assemblage of blocks that produces the eight-edged convex-concave vertex, if an additional type A 13 block is wedged between the two type A blocks so that its triple convex edge is tangent to the other two blocks' triple convex edges at one point 15 FIG. 15. And a ten-edged convex-concave vertex 16 is formed when two groups of type A double truncated blocks 17, as described for the generation of the eight-edged convex-concave vertex, are joined so that their joined triple convex edges are tangent at one point 18 FIG. 16 and the two remaining exposed truncation surfaces are joined by single truncated blocks FIG. 17.

Although there are only five configurations of convex-concave vertices possible, far more complicated designs can be made when producing them than can be seen in the exploded drawings. The double truncated blocks 13 could all be triple truncated and then joined to additional blocks to add to the complexity of any of the groupings in the drawings FIGS. 12–17. Using single and double truncated blocks tends to simplify (i.e. clarify) the basic forms possible, for example a simple homohedral ring FIGS. 18–19 may be constructed using only twenty double truncated blocks, while a heavenly helix FIGS. 20–21 can be assembled from a plurality of double truncated blocks and two single truncated blocks.

In this specification I have tried to encompass as many variations of the invention as was proper. These variations are descriptive rather than merely limiting. Additional variations which the claims encompass but are not listed in the specification are omitted for lack of space or obviousness.

I claim:

1. A set of interengageable toy blocks in which the set is comprised of at least four icosahedral blocks, each icosahedral block being truncated about a vertex by the removal of five icosahedral faces about said vertex, with at least one of said blocks being truncated only about one vertex point, at least a second one of said blocks being truncated about two opposing vertex points, at least a third one of said blocks being truncated only about two non-adjacent, non-opposing vertex points, and at least a fourth one of said blocks being truncated about three non-adjacent, non-opposing vertex points; each truncation surface thus formed on each of said blocks having a means of engagement to a compatible truncation surface on another said block, so that a closed pentangular edge is formed by the two engaged truncation surfaces, when two said blocks are engaged.

2. A set of interengageable toy blocks as claimed in claim 1 in which said means of engagement, between said truncation surfaces is a pin and aperture type engagement means.

3. A set of interengageable toy blocks as claimed in claim 2 in which said pin is detachable from said truncation surfaces.

4. A set of interengageable toy blocks as claimed in claim 2 in which said pin and aperture are pentangular in cross section.

5. A set of interengageable toy blocks as claimed in claim 1 in which said icosahedral blocks are based on regular icosahedra.

* * * * *